US006623916B2

(12) United States Patent
Karthäuser

(10) Patent No.: US 6,623,916 B2
(45) Date of Patent: Sep. 23, 2003

(54) PHOTOGRAPHIC SILVER HALIDE EMULSION

(75) Inventor: Silvia Karthäuser, Köln (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/835,534

(22) Filed: Apr. 16, 2001

(65) Prior Publication Data

US 2001/0044082 A1 Nov. 22, 2001

(30) Foreign Application Priority Data

Apr. 17, 2000 (DE) ..... 100 18 934

(51) Int. Cl.[7] ..... G03C 1/015
(52) U.S. Cl. ..... 430/567; 430/569
(58) Field of Search ..... 430/567, 569

(56) References Cited

U.S. PATENT DOCUMENTS 4,359,526 A * 11/1982 Walworth ..... 430/568
5,254,454 A * 10/1993 Mimiya et al. ..... 430/569
5,286,621 A * 2/1994 Verbeeck ..... 430/567
5,358,841 A * 10/1994 Ohtani ..... 430/569
5,457,021 A * 10/1995 Olm et al. ..... 430/567
5,576,170 A * 11/1996 Eikenberry et al. ..... 430/567
5,807,664 A * 9/1998 Suzuki ..... 430/567
6,096,495 A * 8/2000 Kasai et al. ..... 430/569
6,136,524 A * 10/2000 Verrept et al. ..... 430/569
6,218,098 B1 * 4/2001 Jezequel et al. ..... 430/569

* cited by examiner

*Primary Examiner*—Janet Baxter
*Assistant Examiner*—Amanda C. Walke
(74) *Attorney, Agent, or Firm*—Connolly Bove Lodge & Hutz LLP

(57) ABSTRACT

A tabular silver chloride iodide or silver chloride-bromide-iodide emulsion with a chloride content of at least 90 mol %, an iodide content of 0.01 to 5 mol % and a cubic habit, which is characterized in that with respect to the projected area of all the crystals at least 80% of the crystals have an average aspect ratio of at least 8, a maximum crystal thickness distribution width of 15% and a maximum particle size distribution width of 25%, and which can be produced by a new process, wherein the supersaturation during crystal growth is adjusted within a defined range, is distinguished by high spectral sensitivity and by good stability on storage at elevated temperatures and particularly at high atmospheric humidities.

9 Claims, 1 Drawing Sheet

PHOTOGRAPHIC SILVER HALIDE EMULSION

Figure 1:
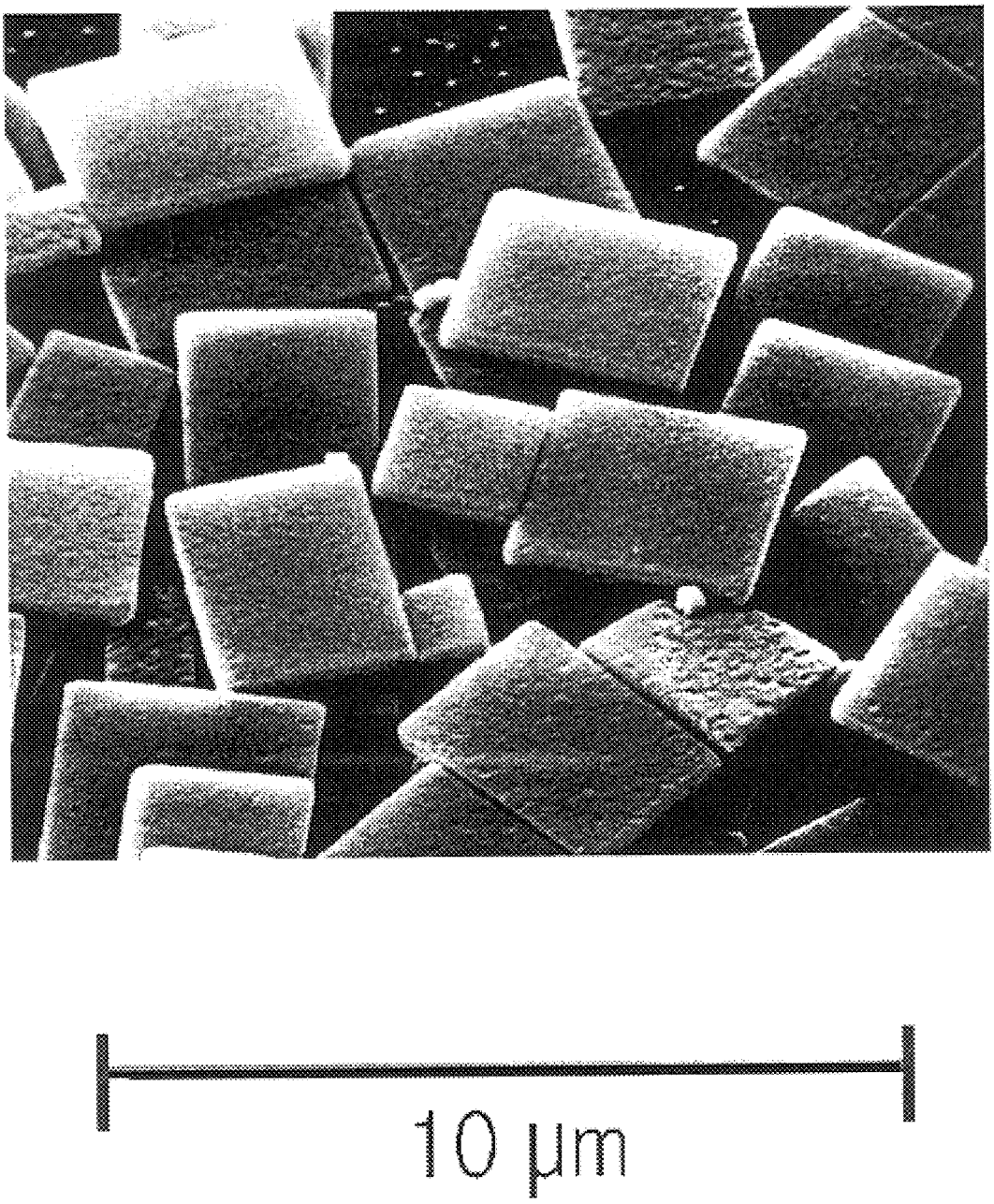

This invention relates to tabular silver chloride-iodide or silver chloride-bromide-iodide emulsions with a chloride content of at least 90 mol %, an iodide content of 0.01 to 5 mol % and a cubic habit, to a process for producing these emulsions and to photographic materials which contain said emulsions.

It is known from U.S. Pat. No. 5,320,938 that (100) AgCl tab grains with an aspect ratio of up to 20 can be produced, wherein the tab grains occupy at least 50% of the projected area. As illustrated in an electron microscope photograph, however, the emulsion contains a high proportion of cubes and thus does not exhibit sufficient homogeneity of the (100) AgCl tab grains for use in practice.

In U.S. Pat. No. 5,663,041 and U.S. Pat. No. 5,641,620, attempts are made to increase the homogeneity and aspect ratio of(100) AgCl tab grains by the re-dissolution of micrate. This costly process is beset by the difficulty that at the commencement of the growth phase of the (100) AgCl tab grains the differences in solubility between micrate and (100) AgCl crystal nuclei are not large, and high degrees of supersaturation have to be ensured at the end of the growth phase in order to re-dissolve the entire micrate. This also results in a large proportion of cubes or in a population of micrate in the batch which is not re-dissolved if the degree of supersaturation at the end of the growth phase was set too low.

These difficulties associated with the micrate dissolution process were recognized by P. Verrept, who at the IS+T's 50th Annual Conference (1997) proposed a process for producing Ag(Cl,I) (100) tab grains in which crystal growth was effected by employing a double inflow technique. In this process, however, it is essential that physical ripening of the (100) Ag(Cl,I) tab grains is effected, and this has to be carried out in a prescribed manner. However, since the only driving force for crystal growth of the relatively large crystals is provided by local statistical fluctuations of the supersaturation in the precipitation medium, physical ripening also results in the formation of a large proportion of cubes, i.e. there is insufficient differentiation between crystal faces with and without dislocation lines.

The known chloride-rich (100) tab grain emulsions, which are particularly suitable for photographic materials which are capable of being processed rapidly, exhibit an unsatisfactory spectral sensitivity. Moreover, their stability on storage is unsatisfactory at elevated temperatures and is particularly unsatisfactory at high atmospheric humidities.

None of the known processes of production are successful in producing chloride-rich (100) tab grain emulsions with a very large proportion of tab grains. However, a large proportion of tab grains is a prerequisite for achieving the advantages which are known for crystals such as these, such as a higher spectrally sensitized film speed and improved sharpness. Chemical ripening and spectral sensitization of the crystals can only effectively be optimized if a substantially uniform crystal population is present. This necessity becomes increasingly pronounced with increasing aspect ratio, and in particular is increasingly difficult to achieve for (100) tab grains with increasing aspect ratio. At an identical proportion of the projected area, cubes possess seven times the volume of cubic platelets with an aspect ratio of 8. Even small proportions of cubes, expressed as usual with respect to the projected area of all the crystals, thus make up a large proportion of the total volume of the crystals. Due to their very much smaller surface area, cubes constitute a costly waste of silver halide which scarcely contributes to the spectrally sensitized film speed.

Furthermore, these known processes are costly to carry out and are particularly difficult to scale up from small test batches to larger batch volumes, which makes their use on a production scale very difficult.

The underlying object of the present invention is thus to produce chloride-rich (100) tab grain emulsions which exhibit a high spectral sensitivity and good stability on storage at elevated temperatures, and particularly at high atmospheric humidities.

Surprisingly, it has now been found that this object is achieved for chloride-rich (100) tab grain emulsions if, with respect to the projected area of all the crystals, at least 80% of the crystals have an average aspect ratio of at least 8, a maximum crystal thickness distribution width of 15% and a maximum particle size distribution width of 25%.

A further underlying object of the invention is to provide a new production process which is simple to carry out, which can readily be employed in batch installations of different sizes, and which results in chloride-rich (100) tab grain emulsions which comprise a very large proportion of tab grains with a high aspect ratio as measured on the projection surface of all the crystals and which are distinguished by a high spectral sensitivity and good stability on storage at elevated temperatures and particularly at high atmospheric humidities.

It has now surprisingly been found that this is achieved if the supersaturation of silver halide in the reaction medium satisfies defined conditions during the crystal growth which follows the formation of nuclei.

The present invention therefore relates to a tabular silver chloride-iodide or silver chloride-bromide-iodide emulsion with a chloride content of at least 90 mol %, an iodide content of 0.01 to 5 mol % and a cubic habit, characterized in that, with respect to the projected area of all the crystals, at least 80% of the crystals have an average aspect ratio of at least 8, a maximum crystal thickness distribution width of 15% and a maximum particle size distribution width of 25%.

In particular, the emulsions employed are those for which the aspect ratio is at least 10.

In a further preferred embodiment, the maximum particle size distribution width is 20%.

Emulsions with a chloride content of at least 95 mol % are particularly preferred.

FIG. 1 is a scanning electron microscope photograph of a (100) Ag(Cl,I) tab grain emulsion according to the invention with an iodide content of 0.2%, wherein 94% of the crystals, with respect to the projected area, have an average aspect ratio of 10, a crystal thickness distribution width of 12% and a particle size distribution width of 18% (emulsion example Em-4).

Values of the average aspect ratio, of the crystal thickness distribution width and of the particle size distribution width are obtained by analyzing electron microscope photographs of obliquely shaded emulsion samples. In order to examine a representative cross-section of the emulsion, the number of photographs evaluated is such that at least 1000 emulsion crystals per emulsion are assessed as regards their particle size, aspect ratio and crystal thickness.

The particle size is defined as the diameter of a sphere of equivalent volume to that of a crystal.

The aspect ratio AV of tab grains is defined as $$AV=D/H,$$

where D represents the diameter of the circle with the same area as the projected area of the individual tab grains, H represents the crystal thickness of the tab grains, and the crystal thickness H is measured perpendicularly to the major face.

The particle size distribution width V of an emulsion is defined as $$V[\%] = \frac{\text{standard deviation of the particle size distribution} \times 100}{\text{average particle size}}$$

The crystal thickness distribution width K of an emulsion is defined as $$K[\%] = \frac{\text{standard deviation of the crystal thickness distribution} \times 100}{\text{average crystal thickness}}$$

The present invention further relates to a process for producing said emulsions according to the invention, consisting at least of the precipitation of nuclei and of crystal growth, characterized in that the precipitation of nuclei is followed by at least one crystal growth step in which at least 50% of the total silver in the emulsion is reacted, wherein the edge length r of the crystals is between 0.1 $\mu$m and 10 $\mu$m and the supersaturation in the reaction medium satisfies the inequality $$S < -0.064 \lg\left(\frac{r}{r^*}\right) + 1.43$$

where $$r^* = 1\ nm.$$

The supersaturation S occurs during the addition of the silver salt and halide salt solutions and is defined as $$S = \frac{C}{C_{eq}}$$

where

C=concentration of $Ag^+$ in the reaction medium and $C_{eq}$=equilibrium concentration of $Ag^+$ in the reaction medium.

Numerical values of $C_{eq}$ are given by T. H. James in "The Theory of the Photographic Process", Macmillan Publ. Co., Inc., New York, 4th Edition 1977, and by O. Söhnel and J. Garside in "Precipitation", Butterworth, Heinemann, Oxford 1992, page 30.

The concentration C is calculated from the following formula:

$$C = \frac{C_{Dos} \cdot q_{Dos} \cdot \Delta t_{10}}{V_R(t)}$$

where $C_{Dos}$=concentration of the added silver nitrate solution in mol/l $q_{Dos}$=added volume flow of silver nitrate solution in ml/min $\Delta t_{10}$=mixing time in the reaction vessel in seconds $V_R(t)$=reaction volume per unit time t in liters.

The characteristic mixing time $\Delta t_{10}$, after which the homogeneity of the mixture still differs by 10% from the final stage, essentially depends on the geometry of the reactor, on the arrangement of the inlet tubes, on the geometry and arrangement of the stirrer and on the stirring speed. The determination of the mixing time, as well as the effects of the apparatus thereon, is covered in Ullmann's Encyclopedia of Industrial Chemistry: "Stirring—2.2 Mixing-Time Characteristic", $6^{th}$ Edition, 1999 Electronic Release, and by J. W. Hiby in "Homogenisation", Fortschr. Verfahrenstec. B 17 (1979) 137–155, and by C. J. Hoogendorn and A. P. den Hartog in "Model studies on mixers in the viscous flow region", Chem. Eng. Sci. 22 (1967) 1689–1699.

The edge length r of the tab grain crystals is defined as the average edge length of the major faces thereof. This quantity can be determined directly from electron microscope photographs.

In one preferred embodiment of the process according to the invention, a supersaturation S of at least 10 prevails in the reaction medium during the precipitation of nuclei.

In a further preferred embodiment of the process according to the invention, at least one crystal growth step is effected no later than 5 minutes after the precipitation of nuclei.

The (100) Ag(Cl,I) tab grains according to the invention are preferably produced in the following steps:

Step 1

Precipitation of nuclei by a double inflow of silver nitrate solution and (chloride/iodide) solution into a dispersion medium consisting of water and oxidized gelatine at pCl<3. The iodide content in the ($Cl^-/I^-$) solution is <5%, preferably <1%. The temperature is 20–45° C. 5–30% of the total $AgNO_3$ is precipitated in Step 1.

Step 2

After a pause lasting for a maximum of 5 minutes, preferably 3 minutes, the "adjustment phase" commences. In this adjustment phase, the temperature, pCl and pH are altered so that the optimum conditions exist for the following crystal growth phase (Step 3). During the adjustment phase, the double inflows of $Ag^+$ and $Cl^-$ are controlled so that the supersaturation lies within the range according to the invention. <20% of the total $AgNO_3$ is precipitated in Step 2.

Step 3

A changeover is made to the actual growth phase without a pause, i.e. without stopping the inflows. >50% of the total $AgNO_3$ of the emulsion is precipitated in Step 3. In a preferred embodiment, a "triple jet" of $Ag^+$, $Cl^-$ and gelatine solutions is used in Step 3. The temperature is preferably 50–70° C. in this formulation phase.

Step 4

This formulation phase can be completely omitted. However, if fresh nuclei have been formed in Steps 2 or 3 due to unforeseen effects, the population of fresh nuclei can be reduced—or, in the extreme case, dissolved—by Ostwald ripening.

In a preferred embodiment, double inflows of silver nitrate and alkali halide solutions are added without interruption, 3 minutes after the precipitation of nuclei, during each formulation phase until the completion of crystal growth, i.e. these inflows are also added during the temperature increase or pAg adjustment phases (pAg=the negative logarithm to the base ten of the silver ion concentration). The rates of metered addition are selected so that taking into account the precipitation conditions (temperature, silver ion concentration, chloride ion concentrations, grain size) a supersaturation S is achieved which falls within the range according to the invention. Shortly before it is metered into the vessel, the silver nitrate solution is most preferably mixed in-line with a gelatine solution and is also diluted at the same time. In the crystal growth phase, silver nitrate, alkali halide and gelatine solutions are thus most preferably added using triple inflow ("triple jet") metered addition. It is thereby ensured that even local fluctuations in supersaturation are substantially prevented, and (100) Ag(Cl,I) tab grain emulsions which are more homogeneous can thus be produced. In this connection, the term "more homogeneous" relates to grain size distribution, grain shape and crystal thickness.

The present invention also relates to a photographic material, characterized in that it contains, in at least one layer, a silver halide emulsion according to the invention or a silver halide emulsion produced by the process according to the invention.

Advantageous embodiments the invention are given in the subsidiary claims.

Examples of colour photographic materials include colour negative films, colour reversal films, colour positive films, colour photographic paper, colour reversal photographic paper, and colour-sensitive materials for the colour diffusion transfer process or the silver halide bleaching process.

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part XI (1996), page 624.

Colour photographic paper, which as a rule is less sensitive to light than is colour photographic film, usually comprises the following layers on the support, in the following sequence: a blue-sensitive, yellow-coupling silver halide emulsion layer, a green-sensitive, magenta coupling silver halide emulsion layer, and a red-sensitive, cyan-coupling silver halide emulsion layer. The yellow filter layer can be omitted.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are binders, silver halide grains and colour couplers.

Information on suitable binders is given in Research Disclosure 37254, Part 2 (1995), page 286, and in Research Disclosure 38957, Part IIa (1996), page 598.

Information on suitable silver halide emulsions, their production, ripening, stabilization and spectral sensitization, including suitable spectral sensitizers, is given in Research Disclosure 37254, Part 3 (1995), page 286, in Research Disclosure 37038, Part XV (1995), page 89, and in Research Disclosure 38957, Part VA (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr, or silver chloride-bromide emulsions comprising more than 95 mole % AgCl.

Information on colour couplers is to be found in Research Disclosure 37254, Part 4 (1995), page 288, in Research Disclosure 37038, Part II (1995), page 80, and in Research Disclosure 38957, Part XB (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part XC (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, processes of introduction into the layers of a photographic material, and other processes of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part XD (1996), page 621. The photographic material may additionally contain compounds which absorb UV light, brighteners, spacers, filter dyes, formalin scavengers, light stabilizers, anti-oxidants, $D_{Min}$ dyes, additives for improving the dye-, coupler- and white stability and to reduce colour fogging, plasticisers (latices), biocides and other substances.

Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical processes.

Suitable hardener substances are described in Research Disclosure 37254, Part 9 (1995), page 294, in Research Disclosure 37038, Part XII (1995), page 86, and in Research Disclosure 38957, Part IIB (1996), page 599.

After image-by-image exposure, colour photographic materials are processed by different processes corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIH, XIX and XX (1996), page 630 et seq., together with examples of materials.

EXAMPLES

Example 1

Emulsion Em-1 (Comparison)

35 g of low molecular weight oxidized gelatine and 0.32 g NaCl were dissolved, with stirring, in 1 liter of water at 40° C. in a reactor (mixing time $\Delta t_{10}$ equal to 2 seconds) so that a pCl of 2.25 was obtained. 90 ml of a 1 M $AgNO_3$ solution and 90 ml of a solution which was 0.99 M in NaCl and 0.01 M in KI were added simultaneously to this solution at a rate of metered addition of 60 ml/min. The emulsion was stirred for 5 minutes at 40° C. and was thereafter heated to 60° C. over 20 minutes. 240 ml of a 1 molar $AgNO_3$ solution were added, with continued stirring, at a constant rate of metered addition over 60 minutes. In this process step, which is termed the crystal growth phase, the pCl was first adjusted to 2.35 by adding a 1 molar NaCl solution and was then held constant. This resulted in an emulsion with (100) major faces and the characteristic sizes given in Table 1.

Emulsion Em-2 (Comparison)

The procedure employed was as for Em-1, except that after increasing the temperature to 60° C. the pH in the reaction vessel was adjusted to 6.6. Moreover, the addition of the 240 ml of 1 M $AgNO_3$ solution was effected at a rate of metered addition which was increased from 2.6 to 5.3 ml/min, and the pCl was previously adjusted to 2.4.

Emulsion Em-3 (Invention)

The procedure employed was as for Em-2, except that after increasing the temperature from 40° C. to 60° C. a 1 molar $AgNO_3$ solution and a 1 molar NaCl solution were metered into the reaction vessel. The rate of metered addition was 3 ml/mn. This was also maintained during the pH adjustment and during the pCl adjustment. A changeover was made, without a pause, to the addition of the 240 ml of 1 molar $AgNO_3$ solution, the time of inflow of which was extended to 68 minutes.

Emulsion Em-4 (Invention)

The procedure employed was as for Em-3, except that during the addition of the 240 ml of 1 M $AgNO_3$ solution a 10% gelatine solution was metered in by the "triple-jet" process, and was used for the in-line dilution of the $AgNO_3$ solution shortly upstream of the inflow thereof into the reaction vessel. The rate of metered addition was 2 ml/min.

TABLE 1

| | Em-1 | Em-2 | Em-3 | Em-4 |
|---|---|---|---|---|
| $r_A/\mu m$ | 1.03 | 1.13 | 0.52 | 0.40 |
| $S_A$ | 1.65 | 1.08 | 1.22 | 1.22 |
| $r_E/\mu m$ | 1.52 | 1.75 | 1.80 | 1.82 |
| $S_E$ | 1.18 | 1.55 | 1.16 | 1.05 |
| Particle size distribution width | 27% | 22% | 17% | 18% |
| Aspect ratio | 6 | 8 | 8 | 10 |
| Proportion on projected area | 65% | 73% | 88% | 94% |
| Crystal thickness distribution width | 20% | 17% | 14% | 12% |
| Iodide content (mol %) | 0.25 | 0.25 | 0.2 | 0.2 |
| | comparison | comparison | invention | invention |

r = average edge length of a (100) AgClX tab grain
S = supersaturation
$r_A$, $S_A$ = values at the start of the crystal growth phase
$r_E$, $S_E$ = values at the end of the crystal growth phase As can clearly be seen from Table 1, there is a considerable increase in the proportion of (100) AgCl tab grains on the projected area when the supersaturation falls within the claimed range during the entire crystal growth phase. Moreover, the emulsions are clearly more monodisperse in character, which is manifested by smaller values of the particle size distribution width and of the crystal thickness distribution width.

Example 2

Emulsions Em-5 to Em-8

Emulsion Em-5 was produced as was Em-1, Em-6 was produced as was Em-2, Em-7 was produced as was Em-3, and Em-8 was produced as was Em-4, with the difference that all the amounts used and all the rates of metered addition were increased by a factor of 10. The results for the emulsions which were obtained are summarized in Table 2.

TABLE 2

| | Em-5 | Em-6 | Em-7 | Em-8 |
|---|---|---|---|---|
| $r_E/\mu m$ | 1.31 | 1.62 | 1.78 | 1.80 |
| Particle size distribution width | 29% | 25% | 19% | 19% |
| Aspect ratio | 4–6 | 7 | 8 | 10 |
| Proportion on projected area | 45% | 60% | 85% | 92% |
| Crystal thickness distribution width | 25% | 22% | 15% | 12% |
| | comparison | comparison | invention | invention |

As can be seen from a comparison of Table 1 with Table 2, the proportion on the projected area of the emulsions which are not according to the invention (5 and 6) clearly deteriorates on scaling up by a factor of 10, whilst it remains almost constant for the emulsions according to the invention.

Example 3

The emulsions listed in Table 3 were chemically ripened at 47° C., at a pH of 5.0 and at a pAg of 7.3, with 1.5 $\mu$mol tetrachloroauric acid/mol Ag, 20 $\mu$mol potassium thiocyanate/mol Ag and 15 $\mu$mol thiosulphate/mol Ag.

After cooling to 40° C., the emulsion was sensitized to the blue spectral region with 380 $\mu$mol S-1/mol Ag and was stabilized with 250 $\mu$mol 1-phenyl-5-mercaptotetrazole/mol Ag. The emulsion described above was subsequently mixed with an emulsion of the yellow coupler Y-1 and of the white coupler W-1 in tricresyl phosphate and was deposited on a film base of paper which was coated on both sides with polyethylene.

The layer contained, per $m^2$:

0.75 g emulsion (with respect to $AgNO_3$)

1.38 g gelatine 0.95 g yellow coupler Y-1

0.2 g white coupler W-1

0.29 g tricresyl phosphate.

A protective layer comprising 0.2 g gelatine and 0.3 g hardener H-1 per $m^2$ was cast over this layer. The material was exposed to form an image and was processed by the Ektacolor RA4 process. The film speed data in Table 3 are given with respect to a density of 0.2 above fogging. Relative values are given, with the speed and $D_{min}$ of emulsion Em-1 being set at 100.

A further sample of the material was first stored for 4 days at a temperature of 35° C. and at 90% relative humidity, and was subsequently exposed and processed exactly as described above for the freshly produced material. The differences between the speed (stored) minus the speed (fresh) (ΔE), and between $D_{min}$ (stored) minus $D_{min}$ (fresh) ($\Delta D_{min}$), are given in Table 3.

TABLE 3

| Emulsion | | Rel. speed | Rel. $D_{min}$ | ΔE | $\Delta D_{min}$ |
|---|---|---|---|---|---|
| Em-1 | Comparison | 100 | 100 | −10 | +69 |
| Em-2 | Comparison | 103 | 102 | −12 | +57 |
| Em-3 | Invention | 107 | 98 | −6 | +33 |
| Em-4 | Invention | 109 | 99 | −5 | +43 |
| Em-5 | Comparison | 97 | 98 | −13 | +75 |
| Em-6 | Comparison | 101 | 100 | −11 | +66 |
| Em-7 | Invention | 107 | 99 | −4 | +36 |
| Em-8 | Invention | 108 | 100 | −6 | +45 |

Substances used in the examples:

Y-1

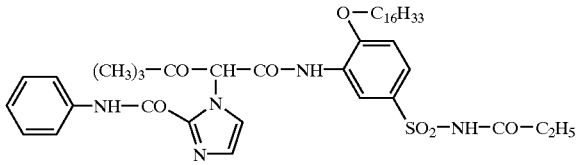

W-1

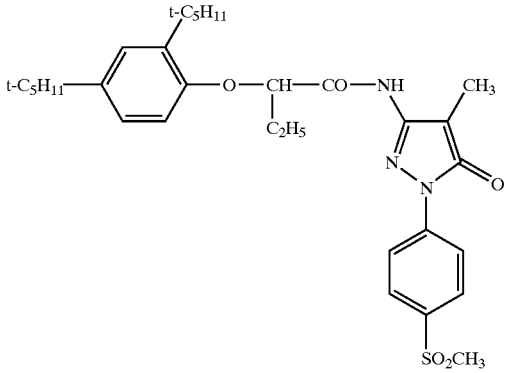

H-1

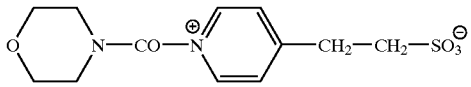

-continued

S-1

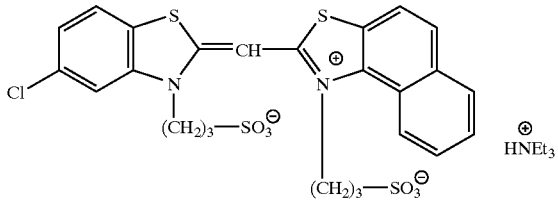

As can be seen from Table 3, the decrease in speed after storage of emulsions Em-3, 4, 7 and 8 was considerably less than that of the emulsions which were not according to the invention. There was also less increase in fogging after storage.

What is claimed is:

1. A tabular silver chloride-iodide or silver chloride-bromide-iodide emulsion with a chloride content of at least 90 mol %, an iodide content of 0.01 to 5 mol % and a cubic habit, characterized in that with respect to the projected area of all the crystals at least 80% of the crystals have an average aspect ratio of at least 8, a maximum crystal thickness distribution width of 15% and a maximum particle size distribution width of 25%.

2. A silver halide emulsion according to claim 1, characterized in that the aspect ratio is at least 10.

3. A silver halide emulsion according to claim 1, characterized in that the maximum particle size distribution width is 20%.

4. A silver halide emulsion according to claim 1, characterized in that the chloride content is at least 95 mol %.

5. A photographic material which comprises, in at least one layer, a silver halide emulsion according to claim 1.

6. A process for producing a silver halide emulsion according to claim 1, which comprises precipitation of nuclei and of crystal growth, wherein the precipitation of nuclei is followed by at least one crystal growth step in which at least 50% of the total silver in the emulsion is reacted, wherein during the crystal growth step the edge length r of the crystals is between 100 nm and 10,000 nm and the supersaturation in the reaction medium satisfies the inequality $$S < -0.064\ {}^{10}\log\left(\frac{r}{r^*}\right) + 1.43$$

where $$r^* = 1\ \text{nm}.$$

7. The process for producing a silver halide emulsion according to claim 6, wherein a triple inflow of solutions of silver salt, halide and gelatine is used during the at least one crystal growth step.

8. The process for producing a silver halide emulsion according to claim 6, wherein the supersaturation S of at least 10 prevails in the reaction medium during the precipitation of nuclei.

9. The process for producing a silver halide emulsion according to claim 6, wherein at least one crystal growth step is effected no later than 5 minutes after the precipitation of nuclei.

* * * * *